US005305955A

United States Patent [19]

Smitherman et al.

[11] Patent Number: 5,305,955

[45] Date of Patent: Apr. 26, 1994

[54] NOZZLE BAR WITH ADJUSTABLE PATTERN

[75] Inventors: John P. Smitherman, Salinas, Calif.; Danny M. Low, Lilburn, Ga.

[73] Assignee: Illinois Tool Works Inc., Glenview, Ill.

[21] Appl. No.: 37,097

[22] Filed: Mar. 25, 1993

[51] Int. Cl.[5] ..... B05B 1/24

[52] U.S. Cl. ..... 239/75; 239/563; 239/133; 239/135; 118/315

[58] Field of Search ..... 239/550, 551, 563, 566, 239/582, 553.3, 39, 564, 128, 133, 135, 75, 104; 118/DIG. 4, 315

[56] References Cited

U.S. PATENT DOCUMENTS

| | | | |
|---|---|---|---|
| 1,776,545 | 9/1930 | Carrington | 239/563 X |
| 3,565,347 | 2/1971 | Denniger . | |
| 4,508,274 | 4/1985 | Eichfeld et al. | 239/563 X |
| 4,630,611 | 12/1973 | Brand | 239/563 X |
| 4,667,879 | 5/1987 | Muller | 239/133 |
| 4,687,137 | 8/1987 | Boger et al. | 239/124 |

*Primary Examiner*—Andres Kashnikow
*Assistant Examiner*—Kevin P. Weldon
*Attorney, Agent, or Firm*—Schwartz & Weinrieb

[57] ABSTRACT

A nozzle bar apparatus for applying a pattern of a viscous material upon a portion of a substrate where the apparatus is adjustable to vary the length, width and position of the pattern relative to the substrate including a nozzle member for selectively dispensing the material in a predetermined pattern and frequency including at least one material flow path through the nozzle member, the flow path having a first end forming an outlet facing the substrate for dispensing the material to the substrate and a second end in operable communication with a material supply for providing a flow of viscous material, the outlet having a predetermined range defining a width of the pattern, the nozzle member being activated for a selected period of time to control a length of the pattern and including a pattern control mechanism for selectively varying the width as well as the position of the pattern anywhere across the range of the outlet.

10 Claims, 2 Drawing Sheets

NOZZLE BAR WITH ADJUSTABLE PATTERN

BACKGROUND OF THE INVENTION

1. Field of the Invention

This invention relates generally to material dispensing assemblies and more particularly to an assembly including an adjustable nozzle bar for dispensing a viscous material, such as an adhesive, onto a moving substrate in a variable pattern and frequency where the length, width and position of the pattern are readily adjustable with respect to the substrate and the nozzle bar is readily interchangeable with a nozzle bar having a different pattern.

2. Description of the Related Art

Nozzle assemblies are utilized to dispense a viscous adhesive onto containers, such as end flaps of cardboard boxes, prior to closing and filling the container with a desired material. An example of such an assembly is illustrated in pending U.S. application Ser. No. 07/962,666 which is assigned to the same assignee as the assignee herein. In that application, to vary the pattern of the adhesive applied, the nozzle assembly typically is removed and another nozzle assembly having the desired pattern is substituted.

Another way to vary the applied pattern is to provide a plurality of individual elongate nozzle outlets which in tandem comprise the entire pattern and then controlling each outlet with a separate dispensing solenoid valve. An example of such a device is illustrated in U.S. Pat. No. 4,687,137. That device, however, is not capable of varying the width of the pattern provided by the individual elongate nozzle outlets.

Additionally, U.S. Pat. No. 4,667,879 discloses a thermoplastic material applicator having an adjustable slot nozzle whose pattern is adjustable by rotation of a cylinder. The cylinder is mounted within the material flow path and, by rotating the cylinder, the width of the pattern can be adjusted about a center line of the slot nozzle.

Such an assembly, however, is not readily interchangeable to provide a different pattern of adhesive and is only capable of varying the width of the pattern about a center line of the slot nozzle. Accordingly, With that assembly it is not possible to position the pattern as desired across the slot nozzle, such as toward one end of the slot.

It therefore would be desirable to provide a material dispensing assembly having a nozzle bar which is readily interchangeable with another nozzle bar having a different pattern and is completely adjustable while mounted to the assembly to vary the length, width and position of the pattern anywhere across the nozzle bar and substrate to which the adhesive is applied.

SUMMARY OF THE INVENTION

The invention provides a nozzle bar apparatus for applying a pattern of a viscous material upon a portion of a substrate where the apparatus is adjustable to vary the length, width and position of the pattern relative to the substrate. The apparatus includes a nozzle member for selectively dispensing the material in a predetermined pattern and frequency including at least one material flow path through the nozzle member. The flow path includes a first end forming an outlet facing the substrate for dispensing the material to the substrate and a second end in operable communication with a material supply for providing a flow of viscous material.

The outlet has a predetermined range defining a width of the pattern. The nozzle member is activated for a select®d period of time to control a length of the pattern and includes a pattern control mechanism for selectively varying the width as well as the position of the pattern anywhere across the range of the outlet.

BRIEF DESCRIPTION OF THE DRAWINGS

Various other objects, features, and attendant advantages of the present invention will become more fully appreciated from the following detailed description, when considered in connection with the accompanying drawings in which like reference characters designate like or corresponding parts throughout the several views, and wherein.

DESCRIPTION OF THE PREFERRED EMBODIMENTS

Figure 1:
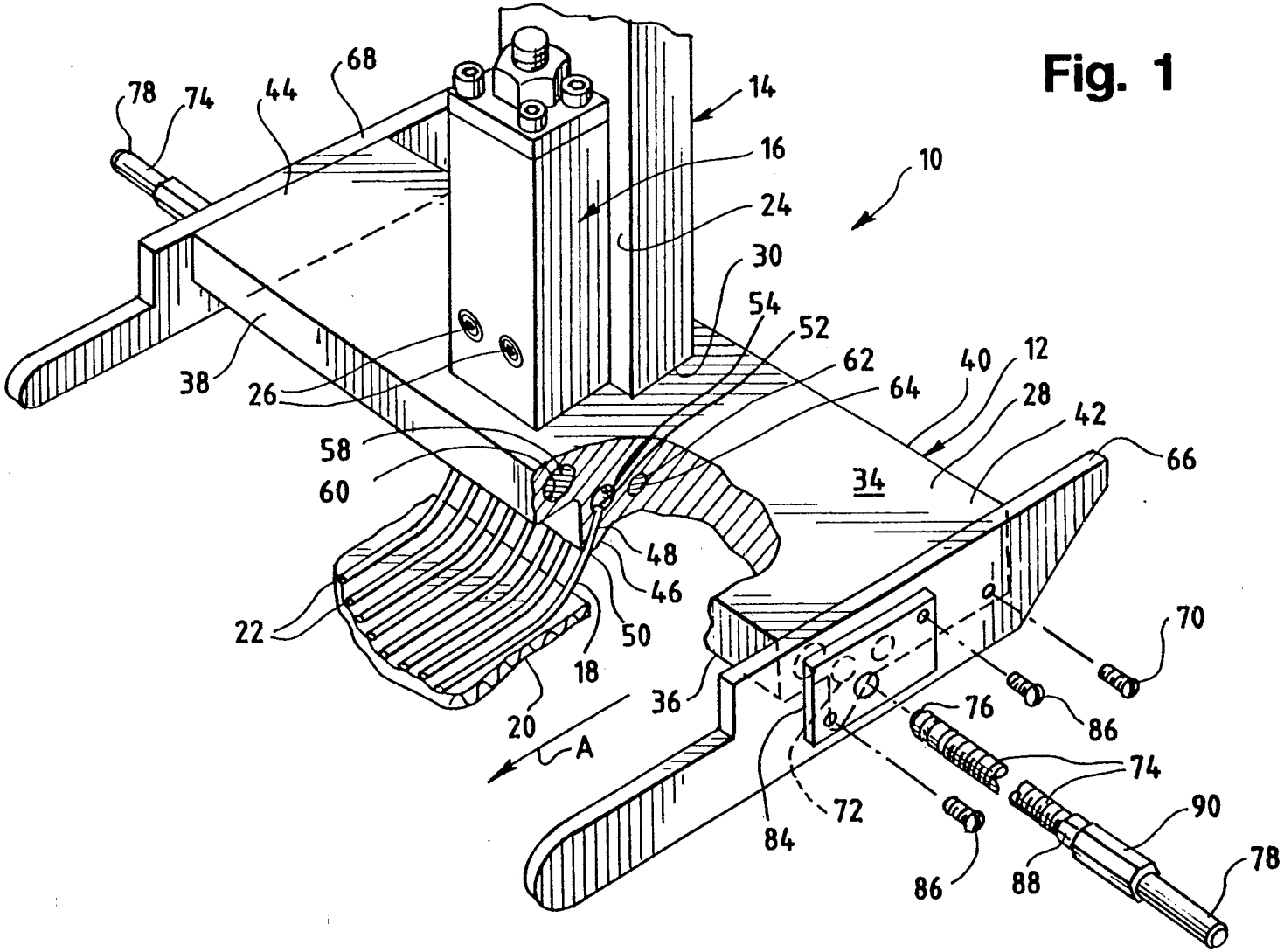
FIG. 1 is a perspective view, in partial section, of a material dispensing assembly of the invention including the interchangeable nozzle bar and associated adjusting mechanism.

Referring to FIG. 1, the adjustable material dispensing assembly of the invention is generally designated by the reference numeral 10. The assembly 10 includes an adjustable dispensing head 12, a mounting or service block 14 and a modular valve 16.

Briefly, in operation, the assembly 10 is utilized to apply an adhesive 18 in a precise predetermined pattern onto a desired surface or substrate 20, such as end flaps of a carton or the like. One or more assemblies 10 can be utilized to apply the adhesive 18 to the surface 20 which is preferably conveyed past the assembly 10 in the direction indicated by arrow "A". It is to be understood, however, that the number of assemblies 10 can vary and can be designed for movement with respect to a moving or stationary surface 20, if desired.

The predetermined pattern of adhesive 18 illustrated is selected for use in a sift-proof type of container, but can vary. The adhesive 18 is preferably applied in a plurality of closely spaced narrow rows or beads 22 which span the entire longitudinal length of the dispensing head 12 and extend perpendicular to the longitudinal axis of the dispensing head 12.

The surface 20 which is to receive adhesive 18 passes through at least a portion of a plane positioned a predetermined distance beneath the dispensing head 12 and is conveyed in the direction of arrow "A". The distance and speed between the dispensing head 12 and the surface 20 can vary and typically depends upon the type of adhesive 18 utilized and the desired application.

The service block 14 mounts the assembly 10 to a support or mounting structure (not illustrated) and serves as a connecting point for various inputs (not illustrated) to the valve 16 and the dispensing head 12, such as electrical power and adhesive supply inputs. Preferably, the service block 14 is mounted on one end to the dispensing head 12 and on its opposite end to an arm assembly (not illustrated) which positions one or more assemblies 10 for application of the adhesive 18 to the surface 20 and can provide for movement and/or adjustability of the assembly 10.

The adhesive 18 is preferably a hot melt type of adhesive which is heated to a predetermined temperature before being conveyed to the assembly 10. The exact temperature can vary, depending on the type of adhesive 18 utilized and the desired application. As will be explained in detail below, the dispensing head 12 includes a heat source and a temperature sensor close to the point of application of the adhesive 18 to pre-heat, monitor and maintain the desired temperature of the dispensing head 12 and to maintain the temperature of the adhesive 18 during dispensing.

The valve 16 is connected to a front surface 24 of the service block 14 by bolts 26 and can be a solenoid type valve or gun or any other type of material dispensing device. As described below, the valve 16 controls and directs the adhesive 18 to outlet nozzles formed with the dispensing head 12 to dispense the adhesive 18.

Figure 2:
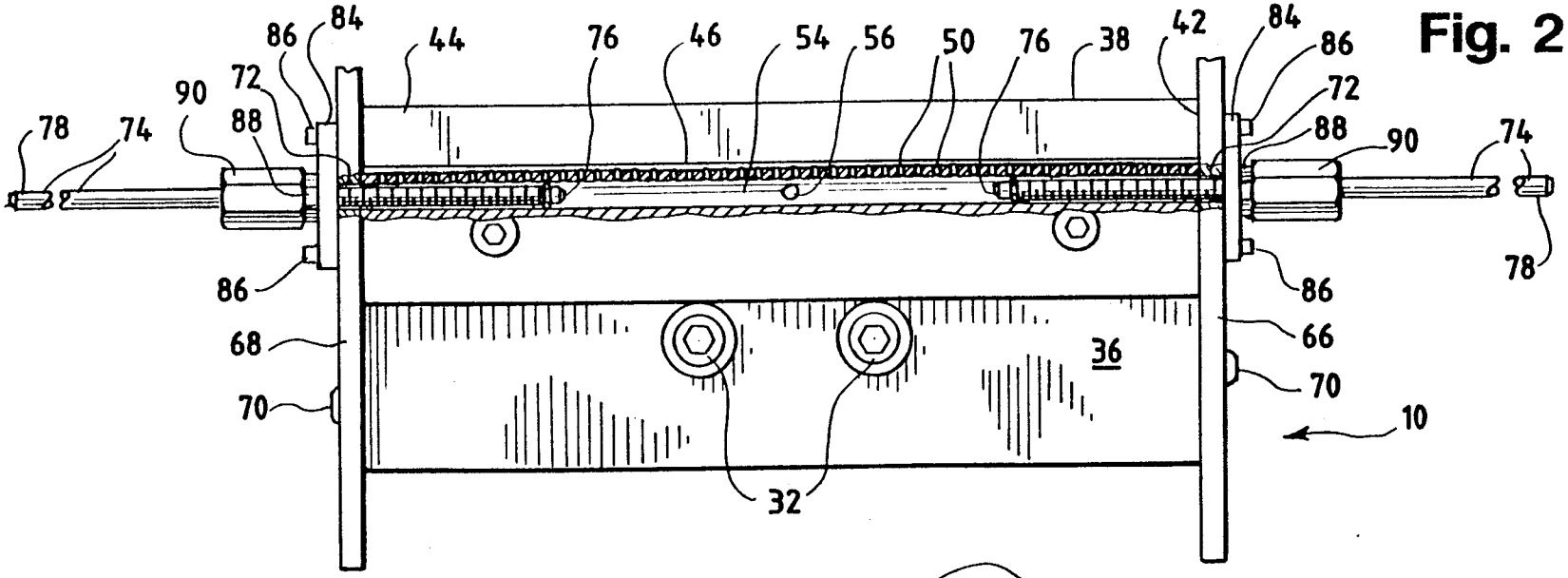
FIG. 2 is a bottom plan view, in partial section, of the nozzle bar of the invention illustrating a row of dispensing nozzles or outlets of the nozzle bar and the adjusting mechanism therein.

The adjustable dispensing head 12 includes a nozzle bar 28 which is preferably formed in one-piece and is connected to a bottom surface 30 of the service block 14 by two bolts 32, illustrated in FIG. 2. To provide adhesive 18 to the nozzle bar 28 from the valve 16, a quick-connect type of connection and seal is provided between the nozzle bar 28 and valve 16 which provides the desired seal upon snapping engagement therebetween.

Thus, the use of a quick-connect seal and the two bolts 32 enable rapid interchangeability of the nozzle bar 28 with other nozzle bars (not illustrated) having different sizes and/or adhesive patterns. It is to be understood, however, that the particular connections between the nozzle bar 28, the service block 14 and the valve 16 can vary, so long as the quick connection and desired adhesive flow are provided.

As FIGS. 1 and 2 illustrate, the nozzle bar 28 is substantially a rectangular die member formed from a single piece of material, preferably metal, and includes a top surface 34, a bottom surface 36, a front side 38, a rear side 40 and first and second opposite ends 42 and 44, respectively. In order to extrude adhesive 18 in a precise position, the bottom surface 36 includes an outwardly extending elongate nozzle portion 46 which spans the length of the nozzle bar 28 proximate the front side 38. As FIG. 1 illustrates, to provide the individual rows of adhesive 18, the nozzle portion 46 includes a plurality of parallel channels 48 formed therein. Each channel 48 includes a first outlet end 50 facing the surface 20 and the direction of travel "A" and a second inlet end 52 and is positioned at a predetermined angle with respect to the bottom surface 36 of the nozzle bar 28. The nozzle bar 28 preferably includes forty-six channels 48 along its length, but the number can vary between twenty and eighty and may be outside that range if desired. The angle of each channel 48 is an acute angle to provide the nozzle bar 28 with the ability to dispense precise rows 22 of adhesive 18 without any dripping or stringing of adhesive, especially with extremely viscous adhesives. The channels 48 are substantially identical to the channels formed in the nozzle bar of assignee's copending application referenced above.

As FIGS. 1 and 2 illustrate, a longitudinal bore 54 is provided completely through the nozzle bar 28 and is in communication along its length with the second inlet end 52 of each channel 48. The bore 54 is provided adhesive 18 through one or more passageways 56, illustrated in FIG. 2, formed through the nozzle bar 28 and extending between the bore 54 and the top surface 34 for communication with the valve 16.

As FIG. 1 illustrates, in order to pre-heat and maintain the nozzle bar 28 at a desired temperature, a heater member 58 is provided within a longitudinal aperture 60 formed in the nozzle bar 28 proximate the bore 54 and channels 48. Preferably, the heater member 58 is an electrical resistance type of heater which extends along the length of the nozzle bar 28 and provides for mounting of an electrical lead (not illustrated) between the heater member 58 and service block 14 or any other member.

To monitor the temperature, a sensor 62 is positioned within a longitudinal aperture 64 formed within the nozzle bar 20 proximate the bore 54 and channels 48. The sensor 62 is preferably connected to a temperature controller (not illustrated) which regulates the temperature of the nozzle bar 28. Due to the close proximity of the sensor 62 and heater member 58 to the channels 48 and the bore 54, the temperature of the adhesive 18 is also regulated to insure accurate application.

All of the electrical and control equipment can be located remote from the assembly 10 and connected to the nozzle bar 28 in any desired manner. Alternatively, some of this equipment can be mounted to the top surface 34 of the nozzle bar 28 (not illustrated) and connected to the heater 58 and sensor 62 with appropriate connections to external power sources and any additional control and monitoring devices.

As FIGS. 1 and 2 illustrate, to assist in holding down and guiding the surface 20 as it passes beneath the assembly 10, the first and second opposite ends 42 and 44 of the nozzle bar 28 include a guide member 66 and 68, respectively, connected thereto by bolts 70. To accommodate the adjusting member described below, each guide member 66 and 68 includes an aperture 72 therethrough.

To adjust the width of the pattern being applied, two adjustable screws or pistons 74 are inserted through the apertures 72 and within the adhesive bore 54, one each from a respective end 42 and 44 of the nozzle bar 28. Each screw 74 includes first and second opposite ends 76 and 78 and is threaded substantially along its entire length.

Figure 3:
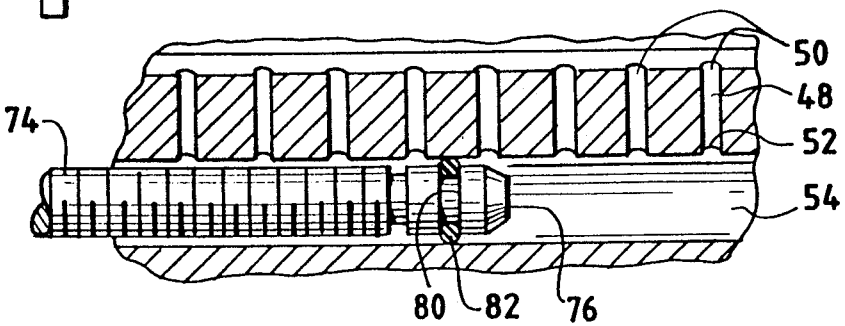
FIG. 3 is an enlarged view, in partial section, of an adjusting mechanism illustrated in FIG. 2.

The first end 76 of each screw 74 is positioned within the bore 54 to a predetermined distance. As FIG. 3 illustrates, to provide a seal between each screw 74 and the bore 54, each screw 74 includes an annular shoulder 80 within which an o-ring 82 is seated.

As FIGS. 1 and 2 illustrate, to assist in mounting the screws 74 to the guide members 66 and 68, a plate 84 can be mounted to each guide member 66 and 68 by screws 86. To maintain the position of the screws 74 with respect to the plates 84, each screw 74 includes a nut 88 and a threaded standoff 90.

In operation, to adjust the width of the adhesive 18 being applied, the screws 74 merely are adjusted within the bore 54 to a desired position. This prevents adhesive 18 from reaching the channels 48 which are not to receive adhesive 18 and thus determines the width of the pattern.

Figure 5:
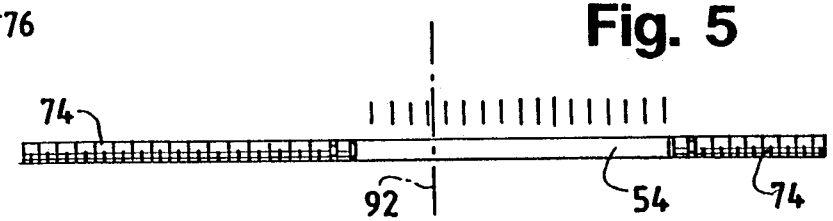
FIG. 5 is a schematic view of another possible dispensing pattern which can be provided by the nozzle bar of the invention.
Figure 4:
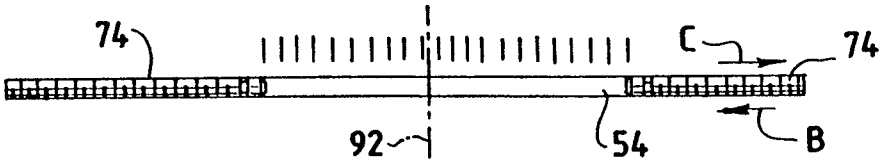
FIG. 4 is a schematic view of a possible dispensing pattern which can be provided by the nozzle bar of the invention.

It is to be noted that the width of the pattern can be adjusted about a longitudinal center line 92 of the bore 54, as FIG. 4 illustrates, by moving the screws 74 either inward or outward in the direction of arrows "B" or "C". Additionally, as FIG. 5 illustrates, the position of the adhesive 18 applied can be moved with respect to the longitudinal center line 92. This enables adhesive 18 to be applied in any width and at any position along the length of the nozzle bar 28, such as at one end 42 or 44.

Additionally, the structure of the adjusting screws 74 enables the desired rapid interchangeability between nozzle bars 28 to accommodate different product runs. Furthermore, the position of the screws 74 within the bore 54 can be maintained while the nozzle bar 28 is in storage awaiting use.

During adjustment of the screws 74, the o-ring 82 and shoulder 80 can rotate with the screws 74 or the first end 76 can be formed with a swivel-type connection (not illustrated) which enables the screws 74 to be rotated and moved longitudinally without rotating the o-ring 82 and shoulder 80. Additionally, although the screws 74 are preferably rotated by hand or with a tool, a motor or control assembly (not illustrated) can be provided to automatically adjust the screws 74.

Modifications and variations of the present invention are possible in light of the above teachings. It therefore is to be understood that within the scope of the appended claims the invention may be practiced otherwise than as specifically described.

What is claimed and desired to be secured by Letters Patent is:

1. Apparatus for depositing a pattern of a viscous material upon a portion of a substrate movable disposed within a plane relative to said apparatus, wherein said apparatus is adjustable so as to vary the length, width, and position of said pattern of said viscous material relative to said substrate, comprising:

viscous material supply means for supplying said viscous material to be deposited upon said substrate;

a nozzle bar having a longitudinal extent;

a longitudinal bore defined within said nozzle bar and extending throughout said longitudinal extent of said nozzle bar so as to have first and second oppositely disposed open ends, said longitudinal bore being fluidically connected to said viscous material supply means so as to receive a supply of said viscous material from said viscous material supply means;

a plurality of channels defined within said nozzle bar along said longitudinal extent thereof, fluidically connected at first end portions thereof to said longitudinal bore so as to receive said viscous material from said longitudinal bore, and defining material dispensing outlets, facing the substrate for dispensing the material onto said substrate, at second opposite end portions thereof which are disposed at an acute angle with respect to said plane of said substrate so as to prevent dripping and stringing of said viscous material as said viscous material is deposited upon said substrate;

heating means disposed within said nozzle bar at a position adjacent to said longitudinal bore and said plurality of channels for heating said nozzle bar and said viscous material to a predetermined temperature;

sensor means disposed within said nozzle bar at a position adjacent to said longitudinal bore and said plurality of channels and operatively connected to said heating means for sensing the temperature of said nozzle bar and controlling said heating means so that the temperature of said nozzle bar and said viscous material is regulated to said predetermined temperature; and means adjustably movable within said first and second oppositely disposed open ends of said longitudinal bore for selectively preventing said viscous material, as supplied from said viscous material supply means, from reaching predetermined ones of said plurality of channels so as to thereby vary the width, as well as the relative position, of said pattern of said dispensed viscous material along said longitudinal extent of said nozzle bar and with respect to said substrate.

2. The apparatus as defined in claim 1 wherein said nozzle bar is readily interchangeable with similar nozzle bar having different dispensing patterns.

3. Apparatus as set forth in claim 1, wherein:

said viscous material comprises an adhesive; and said substrate comprises at least one flap of a carton to be sealed by means of said adhesive after said adhesive is applied to said at least one flap of said carton.

4. Apparatus as set forth in claim 3, further comprising:

guide means fixedly mounted upon opposite ends of said nozzle bar for engaging said at least one flap of said carton so as to maintain said at least one flap of said carton in a predetermined position relative to said nozzle bar and said dispensing outlets thereof as said at least one flap of said carton passes said nozzle bar and said dispensing outlets thereof as said substrate moves relative to said apparatus within said plane.

5. Apparatus as set forth in claim 1, wherein:

said nozzle bar has said longitudinal extent thereof disposed substantially perpendicular to a predetermined direction of relative movement defined between said apparatus and said substrate such that said nozzle bar extends in a direction transverse to said predetermined direction of relative movement defined between said apparatus and said substrate; and said plurality of channels are disposed within transversely spaced parallel planes along said longitudinal extent of said nozzle bar.

6. Apparatus as set forth in claim 5, wherein:

the number of said plurality of channels defined within said nozzle bar is within the range of twenty to eighty.

7. Apparatus as set forth in claim 6, wherein:

said number of channels defined within said nozzle bar is preferably forty-six.

8. Apparatus as set forth in claim 1, wherein:

said heating means comprises a resistance type heater disposed parallel to said longitudinal bore so as to likewise extend throughout said longitudinal extent of said nozzle bar.

9. Apparatus as set forth in claim 1, wherein:

said means adjustably movable within said first and second oppositely disposed open ends of said longitudinal bore comprises a pair of threaded pistons having inner end portions thereof disposed internally within said longitudinal bore.

10. Apparatus as set forth in claim 9, further comprising:

O-ring seal means disposed upon said inner end portions of said threaded pistons for sealingly engaging circumferential wall portions of said longitudinal bore so as to prevent said viscous material from passing outwardly beyond said pistons.

* * * * *